US005895170A

United States Patent [19]

Chambers et al.

[11] Patent Number: 5,895,170

[45] Date of Patent: Apr. 20, 1999

[54] FLEXIBLE RAISED PAVEMENT MARKER, MOUNTING DEVICE AND METHOD

[75] Inventors: David C. Chambers, Ilderton; Robin G. Pitman, London, both of Canada

[73] Assignee: Minnesota Mining and Manufacturing Company, St. Paul, Minn.

[21] Appl. No.: 08/841,361

[22] Filed: Apr. 17, 1997

Related U.S. Application Data

[63] Continuation of application No. 08/539,650, Oct. 5, 1995, abandoned.

[51] Int. Cl.[6] ..... E01F 9/07

[52] U.S. Cl. ..... 404/10; 404/11

[58] Field of Search ..... 404/9, 10, 11, 404/12, 13, 14, 15, 16, 25–26, 65; 49/49

[56] References Cited

U.S. PATENT DOCUMENTS

| | | | |
|---|---|---|---|
| 358,174 | 1/1887 | Rowland | 404/15 |
| 1,802,940 | 4/1931 | Cornelius . | |
| 2,156,681 | 5/1939 | Dewhirst et al. | 404/65 |
| 2,157,059 | 5/1939 | Rosener | 40/125 |
| 2,192,878 | 3/1940 | Beebe | 40/125 |
| 2,760,757 | 8/1956 | Donaldson et al. | 255/36 |
| 3,216,335 | 11/1965 | Stolarczyk et al. | 94/1.5 |
| 3,257,552 | 6/1966 | Converso | 404/16 X |
| 3,392,639 | 7/1968 | Heenan et al. | 94/1.5 |
| 3,693,511 | 9/1972 | Medynski | 94/1.5 |
| 3,850,536 | 11/1974 | Kone | 404/11 |
| 3,890,054 | 6/1975 | O'Connor | 404/10 |
| 4,078,867 | 3/1978 | Ronden | 404/10 |
| 4,088,416 | 5/1978 | Taylor | 404/16 |
| 4,140,418 | 2/1979 | Holley | 404/11 |
| 4,147,447 | 4/1979 | Heenan et al. | 404/16 |
| 4,195,945 | 4/1980 | Heenan | 404/16 |
| 4,297,051 | 10/1981 | Robinson | 404/11 |
| 4,504,169 | 3/1985 | Jones | 404/11 |
| 4,557,624 | 12/1985 | Walker | 404/16 X |
| 4,577,992 | 3/1986 | Jefferies | 404/16 |
| 4,597,691 | 7/1986 | Clarke | 404/11 |
| 4,634,310 | 1/1987 | Clarke | 404/15 |
| 4,659,248 | 4/1987 | Flanagan | 404/10 |
| 4,697,294 | 10/1987 | Schafer | 404/16 X |
| 4,717,281 | 1/1988 | Shepherd et al. | 404/16 |
| 4,747,981 | 5/1988 | Robinson | 264/1.9 |
| 4,815,818 | 3/1989 | Thomas | 350/102 |
| 4,839,122 | 6/1989 | Weaver | 264/129 |
| 4,848,958 | 7/1989 | Sheldon | 404/11 |
| 4,871,280 | 10/1989 | Modlin | 404/10 |

(List continued on next page.)

FOREIGN PATENT DOCUMENTS

| | | | |
|---|---|---|---|
| 0 308 484 B1 | 2/1993 | European Pat. Off. | E01F 9/06 |
| 1 080 983 | 12/1954 | France . | |
| 2 480 323 | 10/1981 | France | E01F 9/06 |
| WO 88/07606 | 10/1988 | WIPO | E01F 9/06 |
| WO 91/16499 | 10/1991 | WIPO | E01F 9/06 |

OTHER PUBLICATIONS

Acker Bulletin 32 product literture.

KotKurb Ta–6 product literature.

3M VHB™ Double Coated Acrylic Foam Tapes and Adhesives Transfer Tapes Product Literature (1994).

*Primary Examiner*—James A. Lisehora

*Attorney, Agent, or Firm*—David R. Cleveland; Karl G. Hanson

[57] ABSTRACT

A flexible, raised snowplowable pavement marker having a top portion that readily deforms downwardly into a base portion when impacted by vehicular traffic or a snowplow blade. Markers installed in a cavity bored in pavement are anchored in place with grouts or alternatively within an annular ring mounting device. The marker body may be black in color to take advantage of solar activity in improving marker performance and longevity and may be vented to atmosphere to facilitate the downward deflection of the top portion of the pavement marker. A retroreflective sheeting is affixed to the marker so that the marker is highly visible to motor vehicle drivers at nighttime.

49 Claims, 8 Drawing Sheets

U.S. PATENT DOCUMENTS

| | | | |
|---|---|---|---|
| 4,890,054 | 12/1989 | Maeno et al. | 324/58.5 A |
| 4,955,982 | 9/1990 | Paulos | 404/11 |
| 5,066,163 | 11/1991 | Whitaker | 404/10 |
| 5,069,577 | 12/1991 | Murphy | 404/11 |
| 5,074,706 | 12/1991 | Paulos | 404/12 |
| 5,302,048 | 4/1994 | Paulos et al. | 404/11 |
| 5,450,235 | 9/1995 | Smith et al. | 359/529 |
| 5,529,430 | 6/1996 | Jenkins | 404/16 X |

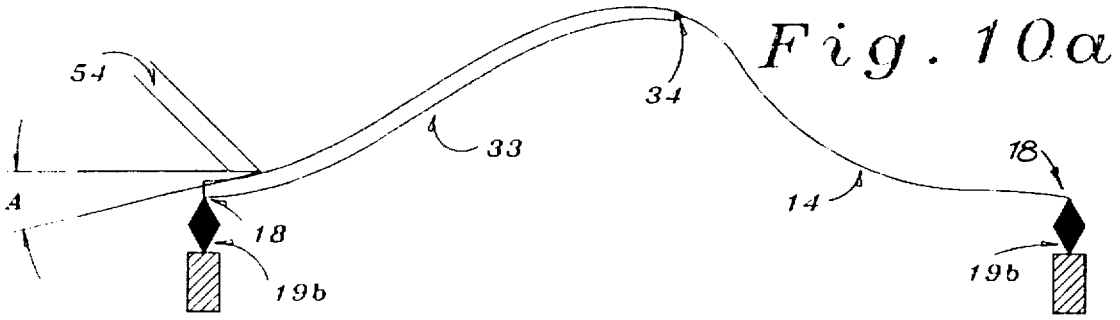
Fig. 10a
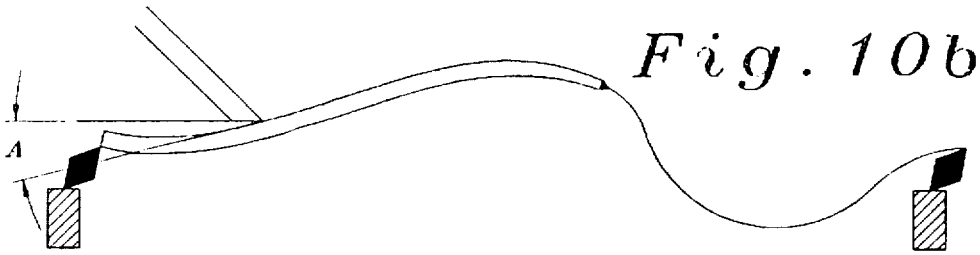
Fig. 10b
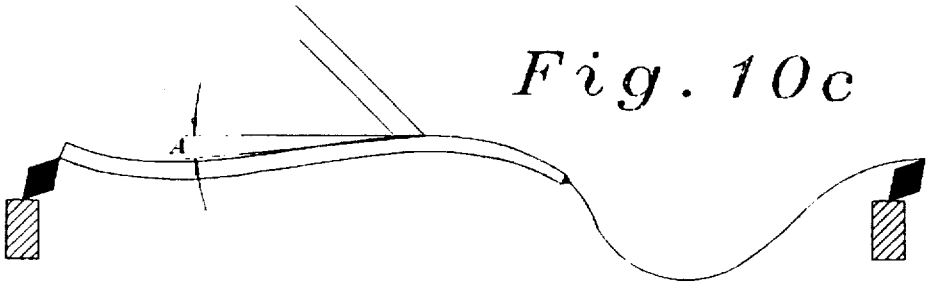
Fig. 10c
Fig. 11
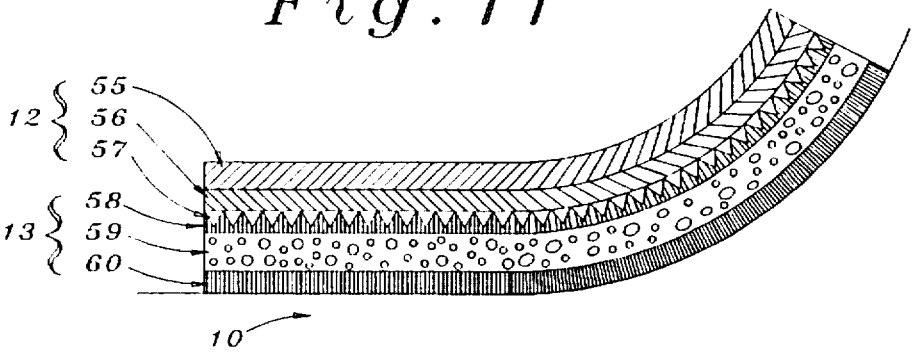

FLEXIBLE RAISED PAVEMENT MARKER, MOUNTING DEVICE AND METHOD

This is a continuation of application Ser. No. 08/539,650 filed Oct. 5, 1995, now abandoned.

TECHNICAL FIELD

The present invention pertains to a flexible raised pavement marker that is readily deflected downwardly upon impact, such as by vehicular traffic or a snowplow blade. It also relates to a device that can be used to mount the marker, or other objects, in a pavement borehole and relates to ongoing maintenance of objects contained within the device.

BACKGROUND OF THE INVENTION

Raised pavement markers have evolved over the past sixty years and serve to delineate areas such as traffic lanes on pavement surfaces. Most pavement markers include some form of reflector to improve motorists' nighttime visual perception. The benefits of raised pavement markers include improved wet reflectivity wherein the markers delineate areas when precipitation on pavement surfaces reflects light from vehicle headlights obscuring markings painted on the pavement. Another benefit of raised pavement markings is improved nighttime visibility over long distances. This contributes to lower motorist visual stress, thus lower fatigue, yielding improved safety for nighttime driving.

Raised pavement markers have been installed at the pavement surface using a variety of fixation means including metal pins, nails, screws or alternatively an adhesive means. Such markers are shown in U.S. Pat. No. 1,802,940 (Cornelius), U.S. Pat. No. 4,088,416 (Taylor), and U.S. Pat. No. 4,717,281 (Shepherd et al.). The use of metal poses a threat because dislodgement of such components may result in increased hazards for vehicles. Metal pins and screws, once dislodged, could find their way into vehicle tires or they could, as the markers themselves, become projectiles on roadways when acted upon by vehicular traffic, particularly at high speeds. One sure method of dislodgement for these types of markers can be from the action of snowplows.

Raised pavement markers have been devised that address the action of snowplows. Such raised, snowplowable pavement markers usually require boring or cutting a cavity within the pavement surface for fixation means. In general, raised snowplowable pavement markers appear as three broad types in their construction:

a) rigid, non-articulated, non-deformable units that withstand substantial impact forces of snowplow blades at high speeds as shown in U.S. Pat. No. 4,147,447 (Heenan et al.), U.S. Pat. No. 4,577,992 (Jefferies) and U.S. Pat. No. 4,634,310 (Clarke). Although somewhat simplistic in their construction, these units typically employ cast metal bases to withstand high impact forces imparted to them by snowplows. Portions of the markers are disposed above the pavement surface and deflect snowplow blades off the pavement surface to protect the reflector mounted on the marker. Retroreflectors mounted on these units also are typically rigid in their construction. These markers although useful, present several difficulties for roadway maintenance operations. Plowblades and the vehicles to which they are attached can suffer considerable fatigue and damage as a result of the plowblade striking the cast metal surfaces at high speeds. The cast metal ramps on this type of pavement marker deflect plowblades upwards off the pavement surface. This can leave snow and ice on the pavement surface in the area immediately about and beyond the marker impact point. The plowblades upon returning to the road surface also may damage the road surface upon impact and can damage or destroy pavement markings resulting in increased pavement maintenance costs. Snowplow operators have experienced nausea from prolonged plowing operations on roadways employing such markers as the impact energy and loud noise transmitted to the plow vehicle enhances operator stress levels. At highway speeds, plow impact with markers can occur as often as once a second. Plowing in snowstorm conditions, in traffic, at high speed for many hours is stressful enough without this additional persistent distraction.

b) articulated units that are mechanical or employ compressible components to allow marker sections that are raised above the pavement to move or retract to survive impacts from snowplows and vehicle tires. Mechanical units such as shown in U.S. Pat. No. 4,140,418 (Holley) and U.S. Pat. No. 4,848,958 (Sheldon) employ metal components that ultimately may deteriorate from the effects of salt and sand materials used on pavements during snow and icing conditions. Although these types of marker are unlikely to impede pavement plowing operations, they require substantial open cavities in pavement to operate.

The cavities are problematic because they are likely to trap debris. Frozen water within the cavities may impede proper function of the units and lead to their destruction by snowplows. U.S. Pat. No. 5,302,048 (Paulos et al.) discloses a pavement marker that can have several of its components replaced, however, the marker employs elaborate mechanical components to provide such, and the impact energy required to deflect the marker top section is believed to be essentially of the same magnitude as that experienced with the rigid, non-deformable units thus presenting many of the road maintenance concerns associated with the rigid units. Further, maintenance of the marker may be difficult.

c) resilient, deformable units, that employ cavities in the pavement to situate and anchor the markers. Most involve a body structure that contains a reflector—although U.S. Pat. No. 3,890,054 (O'Connor) and U.S. Pat. No. 4,815,818 (Thomas) disclose arrays of resilient, fingerlike projections that are reflectorized. Deformable, resilient body types are disclosed in U.S. Pat. No. 4,297,051 (Robinson), U.S. Pat. No. 4,659,248 (Flanagan) and U.S. Pat. No. 5,069,577 (Murphy). Flanagan discloses a unit that resides totally below the pavement surface and would likely survive the action of snowplows but like the mechanical units of Holley and Sheldon, a substantial pavement cavity is required that may fill with debris or water, rendering the retroreflector imperceivable to vehicular traffic. Robinson and Murphy and U.S. Pat. No. 3,850,536 (Kone) employ a cavity cut into the pavement that is intended to accommodate the upper portion of the marker body when deformed by vehicular traffic and snowplow blades. Kone desires air, trapped within the market cavity, to assist in proper operation of the marker. Robinson suggests that with a suitable grout, the internal cavity is airtight and assists the marker in returning to its normal shape and attitude following deformation. The markers are anchored in the cavities in the pavement by capturing a skirt and flange portion of the marker body using suitable grouts. As the side walls or skirt portion of the marker bodies are integrally molded with the flexible top portions, there is potential for side wall deformation upon snowplow impact. Robinson makes provisions to strengthen or stiffen this portion of the marker body to prevent damage to the device upon plow impact.

Most snowplowable pavement markers in use today are rigid, non-deformable cast metal base type markers containing rigid cube corner retroreflectors that are adhesively bonded (usually epoxy) to the metal base. Such markers, as previously described and cited, are installed by cutting or boring a suitable cavity in the pavement to accept the lower portion of the metal base and then fixating the units in the cavity with a suitable epoxy, cement or similar rigid grout. Because of road closure time limitations, these grouts are usually fast setting/rapid cure type materials. Aside from any intended cavities within the marker bodies themselves, the entire cavity cut in the pavement typically is filled with the grout and the marker body material leaving no voids within the pavement.

Given that retroreflectors on raised snowplowable pavement markers are exposed to traffic and studded tires, tire chains, snowplows, road chemicals, and weather, they do not last forever. Reasonable lifetimes are on the order of 2 to 3 years. Efficient replacement of the retroreflectors poses problems in that if a retroreflector is easily removed for replacement, it is likely to become dislodged on impact by vehicular traffic or snowplows. Few published documents disclose details on maintenance or refurbishing methods, or go on to address the inevitable requirements when pavement resurfacing is required.

SUMMARY OF THE INVENTION

The present invention provides a new, flexible, raised, snowplowable pavement marker. The invention also relates to a device that can be used to mount the marker, or other useful objects, in a pavement borehole. The use of combinations of components enables a marker system to be tailored for various applications.

The marker preferably is molded as a single entity containing several regions varying in structure, cross section and function and all acting in concert to assure survivability of the marker over a useful lifetime, particulary in regard to surviving repeated impacts from snowplows at high speed under extreme conditions.

According to an aspect of the invention, there is provided a raised unidirectional pavement marker for installation in a pavement borehole. The marker comprises a body member having a base portion and a generally dome-shaped top portion. The top portion has a first stiffened region and a second flexible region, where the first region has a surface for receiving a retroreflective material. The term "stiffened" is used herein to mean the first region rigid relative to the second region, and the term "flexible" is used herein to mean the second region in general is less rigid than the first region. The second region's flexible nature assists in allowing the top portion to be deflected downward into the base when a force is received on the first region of the top portion. A third flexible region, on the marker body interior, acts as a hinge for the entire top portion. A fourth flexible region, included in the upper one third of the base portion, adds lateral flexibility to the top portion. The pavement marker is sufficiently resilient to enable the top portion to return to its generally dome-shaped configuration upon release of the force from the first region. The resiliency is furnished in part by the second region, whose flexibility allows the top portion to "pop" back into its dome-shaped configuration.

The top portion of the pavement marker, when installed, protrudes above the pavement surface and is exposed to potential detrimental affects from snowplow blades and vehicle tires, in combination with salt and sand, and weather elements including ultra violet solar radiation, precipitation in many forms, and temperature extremes from as low as minus 40 degrees to as high as one hundred and sixty degrees fahrenheit. These temperature extremes are important in that they affect the characteristics of the pavement marker body material. A material that has proved useful In application to this invention is thermoplastic polyurethane, particularly of the polyether type and having a glass transition temperature (Tg) of minus forty degrees or lower. The thermoplastic polyurethane may contain ultraviolet inhibiters to reduce the degradation effects of solar exposure.

In the top portion, the first stiffened region is located in the direction of snowplow impact. This stiff region includes mounting means and preferably a protection means for the reflector. The stiffened region may be achieved by thick cross section of the flexible marker material or alternatively by "coring" this region. Coring is a term used to describe the inclusion of rib structure that stiffens and strengthens an area effectively without adding proportionately to the bulk of the component. Minimizing bulk in the pavement marker first region is desirable as high inertia in this first region is detrimental to survival of the pavement marker when it is expected to immediately move and immediately transmit plow impact energy to effect other responses in other regions of the marker top portion. The collapsing action response of the marker body to impact may be required to happen in as little as two one-thousandths of a second. In this regard, it should be noted that the shape of the first region preferably is substantially cosinusoidal in cross-section (when viewed from a plane bisecting the first region) which allows snowplow impact energy to transfer to the marker in a more gradual fashion than would otherwise occur with other shapes such as convex domes of prior art markers. This gradual build of energy is effected by the initial low tangential approach angle between the plowblade and the marker body surface. This minimises potential for step style impact energy which could cause the plowblade to penetrate the resilient marker body material, resulting in cuts, tears or possible removal of the marker from its mounting. This action is aided by the thinned upper base portion which allows lateral movement of the marker top section upon initial impact of the marker by a snow plow. The response time of the marker is effectively increased by the lateral movement and may add as much as one-half of one thousandth of a second to the time required for the deformation of top section to commence. As the plowblade progresses across the marker body first region, the first region is forced downward and preferably maintains a low tangent angle between the plowblade and the marker body surface. The low tangent angle can minimize energy transfer from the plowblade to the marker body. Hinging action and overall high compliance of the marker material and shape preferably is such that minimum energy is required to depress the marker top portion allowing the plowblade to pass over the marker without damage to the marker. Less efficient designs extract higher energy from the plowblade which must be dissipated in the marker and generally result in marker deterioration or damage.

The first region when hinging downwardly under the influence of impact, transfers energy and acts upon the second region. The pavement marker is mounted on a roadway so that the second region is disposed away from the direction of plow impact. The second region preferably has a symmetrical concave section in its center which predisposes the second region to deflect downwards when acted upon by the first region. The second region preferably is effectively hinged to the first region in the transition area between the regions where the stiffer region meets this more compliant region.

A third region which is more flexible than the second region, e.g., by being thinner, may be provided at the interface between the marker top region and the lower skirt region, preferably at or below the pavement level when the marker is installed. More specifically, the third region preferably is located about the inner periphery of the marker body to effectively perform a hinge function for both the first and second regions when the marker is subjected to impact deformation, allowing these regions to deflect within the cavity bounded by the cylindrical base portion as the plowblade passes over the marker. A fourth flexible region is located about the upper one third of the marker sidewall base portion. This region is more flexible than the lower sidewall base portion by being formed with a reduced thickness in comparison, the flexible upper sidewall section being approximately one half the thickness of the lower sidewall section and approximately equal to the thickness of the flexible second region. This fourth flexible region provides for lateral movement of the marker dome upon plow impact. Lateral movement of the dome decreases the immediacy of the first and second regions to respond to plow impact energy thus increasing the responsive time of these regions and thus imparting greater ability of the marker dome to survive impact. The thinned upper sidewall region is an effective lateral hinge for the marker dome.

According to another aspect of the invention, there is provided a device for mounting an object in a pavement borehole. The device comprises an annular wall of flexible synthetic material having an inner surface and an outer surface. The inner surface is adapted to frictionally engage the object, and the outer surface has a plurality of annular ribs adapted to engage the pavement within the borehole.

According to another aspect of the invention, there is provided a raised pavement marker that comprises a body member having a base portion and a generally dome-shaped top portion. The top portion has a hole to vent the marker to the atmosphere. The top portion can be deflected downward into the base portion upon receiving a force thereon. The pavement marker is sufficiently resilient to enable the top portion to return to its generally dome-shaped configuration upon release of the force.

According to another aspect of the invention there is provided a pavement marker formed of resilient material comprising black polyurethane.

The marker may be mounted in a pavement borehole using the mounting device. Other useful objects also could be mounted using the mounting device of the invention.

Flexible metallised retroreflector material is preferably affixed to the marker with a unique, flexible, weatherable adhesive system.

The raised pavement marker of the invention may be installed in a cavity that has been bored in the pavement. The top section of the marker is dimensioned, shaped, and hinged, such that it deforms and deflects easily into the cavity when impacted by vehicular traffic or a snowplow blade. The marker body is preferably vented to atmosphere. This enables the marker's top portion to rapidly deflect into the base portion when impacted by a snowplow. Venting also allows moisture collected within the marker cavity to evaporate. Venting also may ease the marker installing procedure by eliminating pressure effects of air within the marker cavity. Markers may be installed in the pavement cavity with grout materials or alternatively within a mounting device that has been installed in the cavity. The marker body preferably includes a peripheral skirt comprising a base portion having an integral flange for mounting. The lower two thirds of the peripheral skirt section may also contain a relief area to register the marker body in a predetermined orientation with respect to a mounting device, with such mounting device containing a mating Inverse relief. This registration of marker body and mounting device ensures proper installation of the mounting device relative to traffic direction and also prevents rotation of the marker body within the mounting device. Rotational forces are exerted upon the marker body within the mounting device. Rotational forces are exerted upon the marker body by the typically oblique impact angle of plowblades. When grout is used to install a marker body containing such registration relief in its skirt section, the mating registration relief is formed in the grout.

A mounting device in the form of an annular ring may be provided as an alternative to mounting the marker in the pavement using a rigid or flexible grout. The mounting device can perform multiple functions, including providing ease of mounting for the marker within the pavement cavity at the proper height, providing venting capability to the marker interior, providing easy, fast replacement of marker bodies when refurbishing is required, and counteracting asphalt creep. The mounting device contains a plurality of flexible ribs about its periphery that deform and grip the inner surface of the pavement cavity. Under certain conditions a suitable grout may be used to provide additional anchorage of the mounting device to the pavement. A preferred material for the mounting device is a high density polyethylene that has considerable cold temperature flexibility allowing the mounting device and marker to conform to the pavement topography. Cold impact strength is another feature of this material. A ring seal, manufactured from flexible, closed-cell foam material, such as polyethylene foam with an EVA (Ethyl Vinyl Acetate) additive for flexibility, also may be used. The seal compresses when the mounting device is installed above it. The seal can prevent moisture from collecting beneath the pavement marker, which could freeze and force the ring upwards.

Novel methods and components are employed to install the marker in the pavement. In the case of anchoring the marker in the pavement with the mounting device, the typically hydraulic driven drill equipment, used to form the borehole in the pavement, is used, in conjunction with an insertion fixture, to-drive the preassembled combination of marker and mounting device into the borehole. The drill bit contains unique "kerf" cutting components to ensure markers are installed at proper operating depth in the pavement. In the case of markers mounted in the pavement with grout, a flexible foam band, placed about the borehole centre core, allows the marker to be suspended at proper operating height within the borehole prior to the installation of the anchoring grout. The flexible foam band also prevents grout from entering the interior of the marker and thus creates the beneficial equivalent of a mounting device within the borehole after the grout has cured.

BRIEF DESCRIPTION OF THE DRAWINGS

FIG. 10, comprising parts (a), (b) and (c), is a series of schematic drawings depicting a snowplow blade pass across the marker.

FIG. 11 is a cross-section of the flexible retroreflective material with 3M "VHB" adhesive integrating the retroreflector to the marker body.

DESCRIPTION OF THE PREFERRED EMBODIMENTS

Figure 4:
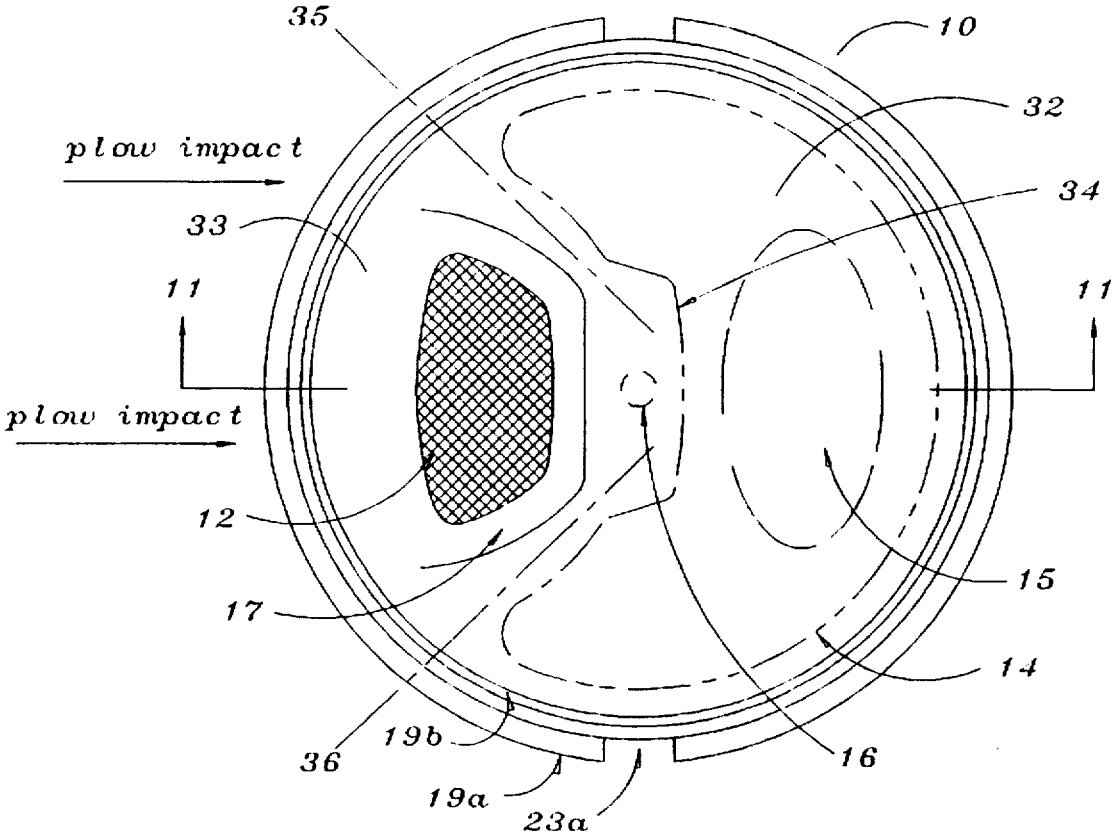
FIG. 4 is a top plan view of the marker.
Figure 5:
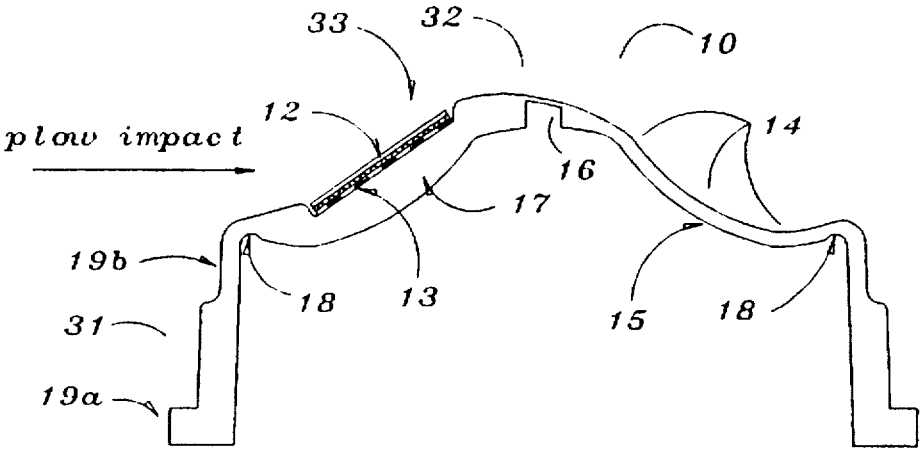
FIG. 5 is a cross sectional view of the marker of FIG. 4 taken along section line 11—11.
Figure 7:
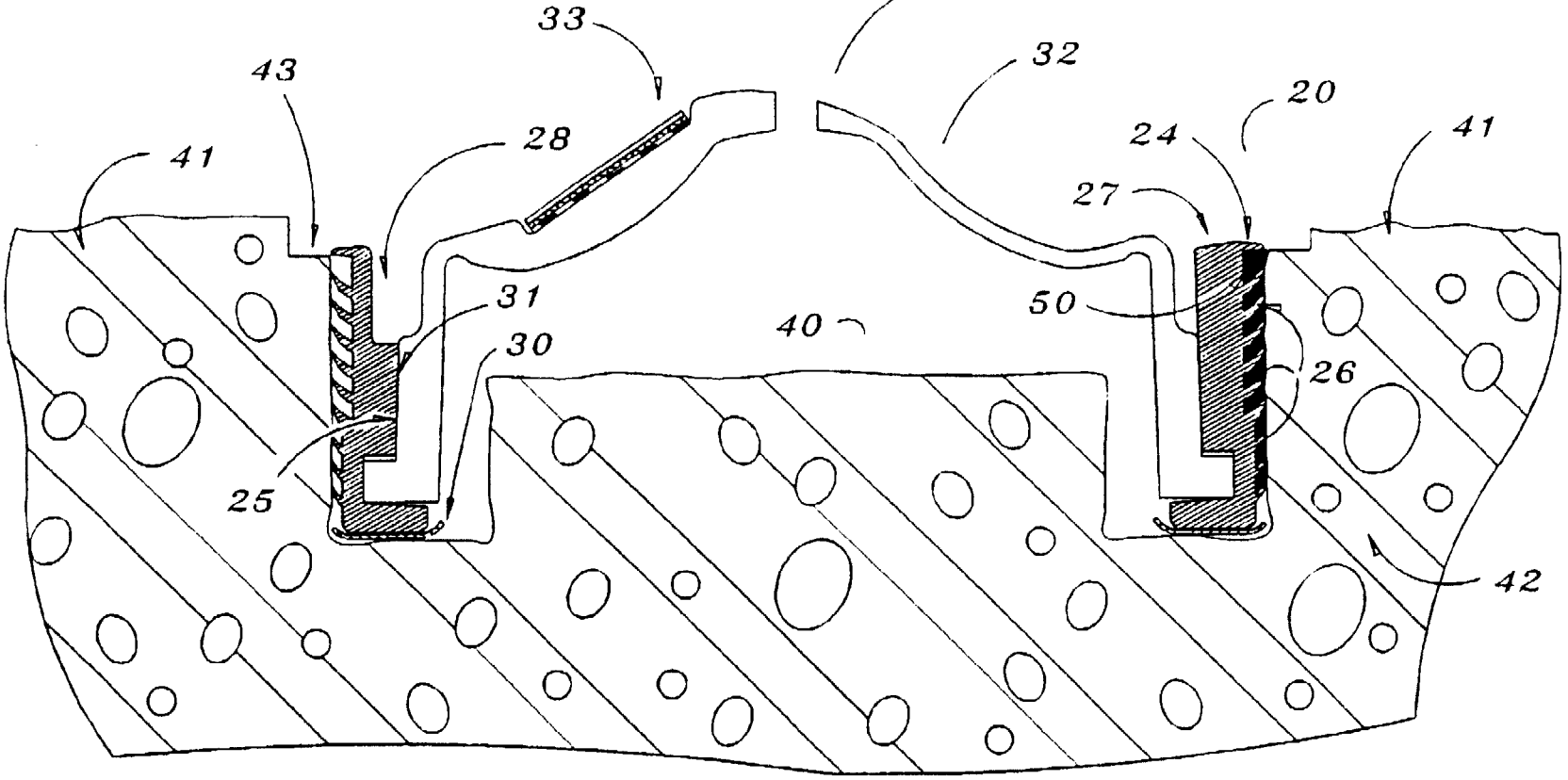
FIG. 7 is a cross sectional view of a marker system assembly installed in pavement.

Referring initially to FIGS. 4, 5 and 7, a body member of a flexible raised pavement marker according to the invention is generally indicated at 10. The body member may be formed, e.g., by injection molding, of resilient material, preferably a flexible polyurethane having a glass transition temperature (Tg) of −40° F. or lower. The body member 10 includes a tubular base portion 31 and a generally dome-shaped top portion 32. The top portion 32 is dimensioned and shaped to deform easily when impacted by vehicular traffic or a snowplow blade. The characterization of the top portion as "generally dome-shaped" means the top portion projects upwardly from the base portion but it does not necessarily have a simple geometrical shape such as exhibited by a hemispherical dome, for example. The marker body top portion 32 has a first region 33 and a second region 14. The second region 14 is more flexible than the first region 33. Preferably, the greater flexibility of the second region 14, as compared to the first region 33, is obtained by making region 14 of thinner material than region 33. The marker body top portion also has a generally U-shaped thickened section 17, thicker than the remainder of the first region 33, which partially encircles and defines an area to receive a reflector described below, preferably a metallized cube-corner retroreflective sheeting. The marker is unidirectional, that is it only reflects light to vehicles approaching the marker from the direction of the reflector 12. The thickened section 17 helps protect the reflector from damage caused by a snowplow blade. The reflector is also protected by a recess encompassed within the thickened section. The thickened section and recess allow a snowplow blade to strike the thickened section 17 rather than the reflector.

The impact of the snowplow blade on thickened section 17 causes the top portion 32 of the marker to deflect downwardly into the base portion 31. Upon impact the first region 33 can pivot downwardly. The downward pivot is enabled, in part, by hinged region 18 and in particular the hinged region extending between lines 35 and 36. When the first region is deflected, the second region 14 also is deflected downwardly, being forced down by the first region 33, which is thicker, and hence stiffer, than region 14, as shown in FIG. 5. A generally concave section 15 in the thinned region 14 of the top portion 32 is preferably provided to aid in deflecting the top portion 32 of the marker body into the tubular base portion 31. The area 15, and also the whole marker body, preferably has substantial mirror symmetry with respect to an imaginary plane 11—11 bisecting the first and second regions of the dome. Area 15 is acted upon by the continuance of thick section 17 in the central top section about partial hole 16.

A fourth region associated with deflection of top portion 32 involves the upper one third of base portion 31. This region **19*b* is characterised as flexible having similar thickness and flexibility characteristics as the second region 14 and being typically one half the thickness of the lower two thirds of base portion 31. This fourth flexible region allows for lateral movement of the marker dome upon plow impact. Lateral movement of the dome decreases the immediacy of the first and second regions of top portion 32 to deflect into base portion 31 thus increasing the required response time of these regions resulting in greater ability of the marker dome to survive impact. The thinned upper region 19*b* of base portion 31** is an effective lateral hinge for the marker dome.

Figure 1:
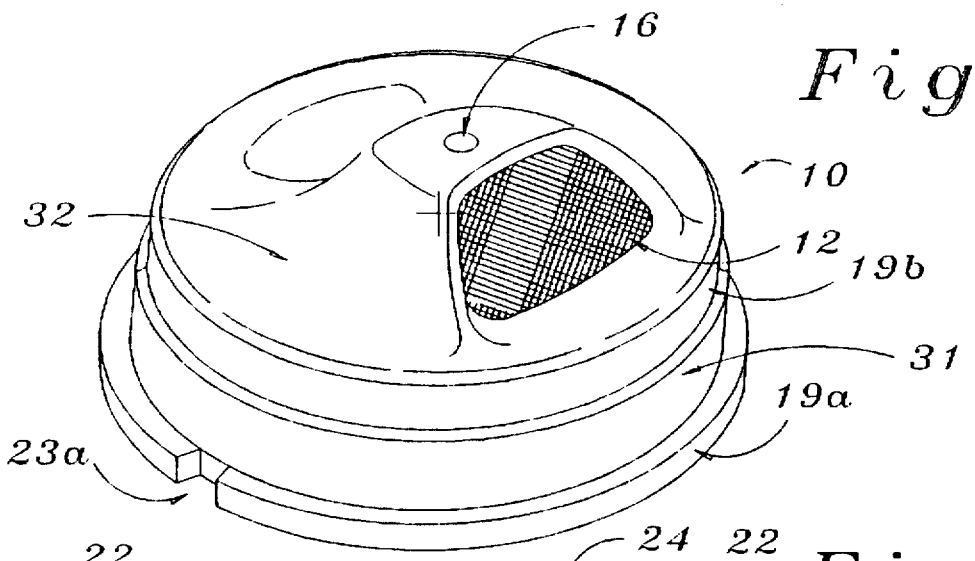
FIG. 1 is a perspective view of a pavement marker according to the invention, equipped with retroreflective material.
Figure 2:
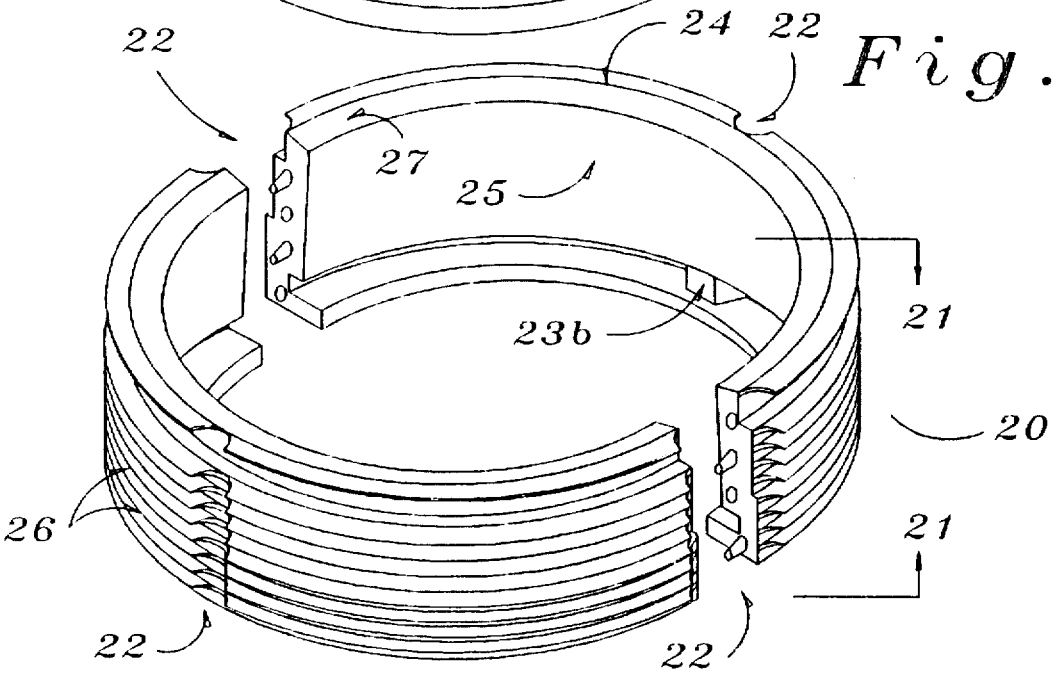
FIG. 2 is a perspective view of an annular split ring mounting device that may be used to mount the marker.

The lower two thirds of base portion 31 may also contain a relief area to register the marker body to a mounting device with such mounting device containing a mating inverse relief. This registration of marker body and mounting device ensures proper installation of the mounting device relative to traffic direction and also prevents rotation of the marker body within the mounting device. Such registration relief **23*a* is shown in FIGS. 1 & 4, although the preferred embodiment would situate such relief opposite to the impact section 33 of the marker body 10. A mating inverse relief 23*b* is shown in FIG. 2 for the mounting device 20**. Rotational forces are exerted upon the marker body by the typically oblique impact angle of plowblades. When grout is used to install a marker body containing such registration relief in its skirt section, the mating registration relief is formed in the grout.

With plow impact at thick section of region 17, immediate and simultaneous energy from the impact is imparted to thinner, more flexible region 14 by region 17 through the thick to thin transition region, about hole 16, deflecting region 14 into the cavity bounded by base portion 31. A hinging action occurs along the juncture 34 of regions 33 and 14, as well as around the peripheral hinged region, specifically in flexible thinned region 18, relative to the tubular base 31. Simultaneous to these actions, the entire marker top portion 32 moves laterally, such movement allowed by the flexible region **19*b* of base portion 31**.

As seen in FIG. 4, the first region 33 extends inwardly from an arcuate base adjacent a segment at the periphery of the top portion 32, to a terminating region 34 beyond the center of the top portion. The arcuate base of region 33 extends, as indicated by lines 35, 36 of this preferred embodiment, around approximately ⅓ of the periphery of the dome and provides mounting means and impact protection means for retroreflector 12. The second region 14 of body member 10 preferably is substantially larger than the first region 33. The hinged section 18 preferably circumscribes the entire upper inner periphery of the tubular base portion or skirt 31 and is thinned, as shown in FIG. 5, to allow the top portion 32 to deflect into the base portion 31.

In preferred embodiments of the marker body according to the invention the thickest section is the thickened section 17 in the stiff first region 33 which is located around the area that receives the retroreflector material 12. The section 17 is approximately 5 to 15 millimeters (mm) thick, preferably 8 to 12 mm. The area surrounded by thickened section 17 is about 4 to 12 mm, preferably 6 to 10 mm, thick. The remainder of the first region 33 is approximately 3 to 9 mm, preferably 5 to 8 mm, thick. The flexible second region 14 is about 1 to 5 mm, preferably 2 to 4 mm, thick. The hinged region 18 generally is about twenty percent less thick than the second region 14. The lower flange 19*a* and the wall of base portion 31 are approximately 3 to 9 mm, preferably 5 to 8 mm thick. The thinned upper one third 19*b* of base portion 31 has the same thickness as second region 14. This shows the first region 33 to preferably have at least the same stiffness factor as the lower sidewall base portion 31, and the thin border region 18 hinges top section 32 vertically while the flexible upper sidewall 19*b* of base portion 31 hinges the top section 32 laterally from the lower sidewall of the base portion 31. The first stiff section 33 could employ "coring", discussed above, to produce stiffness without adding bulk and subsequent inertia to this section.

The preferred area of a vent hole 16 is at least 25 $mm^2$ but may be as large as 50 $mm^2$.

The preferred material for the marker body is polyether polyurethane having:

- a Tg (glass transition temperature) of about −40° F. or lower when measured under Dynamic Mechanical Analysis,
- a shore hardness (measured under ASTM standard D2240-1991) of about 75A to 90A with 80A being preferred,
- a tensile strength exceeding approximately 3,300 psi when measured under ASTM method D412-1992,
- a low temperature stiffness modulus rigidity of 1700 psi maximum at −40° C. when measured under ASTM D1053,
- a Vicat Softening temperature of about 68° C. minimum when measured under ASTM method D1525 (Rate B-1991).

A material that meets these requirements is "Estane" 5881 available from Goodrich Chemical Group.

Polyurethanes that possess such properties provide good deflection and endurance when struck by snowplow blades. When colored black, such polyurethanes exhibit extraordinary durability under the cold and hazardous conditions in which they are exposed.

The marker body member may be integrally colored when molded. An integrally colored pavement marker is one that has a colorant incorporated into the marker body material during manufacture as opposed to coloring the surface afterwards. White or yellow or other colors may be used as regulated for road-markings in some jurisdictions, but black is preferred, for reasons explained hereinafter.

Black coloration of the marker body, using, for example, 1 to 5 weight percent dispersement of carbon black in the body material enhances the performance and longevity of the marker as follows:

a) Solar heating effects:
   i) Solar heating of the marker melts snow on unplowed, snow-covered markers exposing the pavement marker.
   ii) Solar heating assists in evaporating moisture from the marker's interior. Moisture otherwise could build, freeze, and thereby impair the marker's ability to survive impact.
   iii) Direct solar radiation is prevalent during "Cold Snaps" which are dominated by high barometric pressure. Raising marker body temperature during daylight hours reduces body embrittlement, sometimes referred to as "cold ordering" which may occur in urethane with prolonged exposure to temperatures near the material's glass transition temperature (Tg). Solar heating makes the marker more pliable at all temperatures.

b) Raised black-bodied markers perform a high contrast function on snow-covered pavement where the black body itself contrasts with the white snow. Snow may be left on the pavement impairing retroreflective material performance. Fresh snow is also reflective in its own right. Under these conditions, the black bodies prove to be more visible by contrast.

c) Ultraviolet solar radiation can penetrate and degrade material such as polyurethane. The black coloration may reduce penetration of UV radiation and extend the life of the marker.

Although the marker body member 10, which extends above the pavement, normally is visible to motor vehicle drivers, it is preferred to provide it with reflector material, especially retroreflective material, which enhances visibility of the marker, particulary at night. A retroreflective material has the ability to return a substantial portion of incident light in the direction from which the light originated.

Although a number of known retroreflectors may be used, it is preferred in the present invention to use composite retroreflective sheeting that possesses a high degree of flexibility, as well as good brightness and durability, and comprising cube corner retroreflective elements. A preferred cube corner retroreflective sheeting is disclosed in U.S. patent application Ser. No. 08/139,914 filed Oct. 20, 1993, now U.S. Pat. No. 5,614,286, and incorporated herein by reference.

Briefly stated, that patent application describes a conformable prismatic or cube-corner retroreflective sheeting comprising a multitude of discrete cube corner segments that are conformably bonded together. Each cube corner segment comprises a plastic body portion having a substantially planar front major surface and side walls and at least one minute cube corner retroreflective element projecting rearwardly from the body portion and defining a cube corner point side of the cube corner segment. The word "conformable" is used herein to describe a material that is capable of being shaped or formed. In particular, the term "conformable" is used herein to describe materials such as carrier layers and sheetings which are omni-directionally extensible at some ambient application temperature or elevated temperature and can take essentially the same shape as non-planar substrates to which the materials are conformed. The word "discrete" is used herein to indicate that the cube corner segments are not rigidly connected together. The phrase "conformably bonded together" and close variants of this phrase are used herein to indicate that adjacent cube corner segments are at least one of the following: (1) separated by a gap of less than about 1 millimeter and bonded together through a conformable carrier layer; or (2) separated by a gap which is substantially filled with a conformable resin that bonds the side walls of adjacent cube corner segments together. Each cube corner retroreflective element typically has a plurality of facets or faces and a base adjacent the body portion. Typically, substantially all of the cube corner retroreflective elements located closest to the side walls of the body portions are intact and capable of retroreflecting light.

The peripheries of the cube corner segments can be defined by a plurality of separations extending from the cube corner point sides to the front major surfaces of the cube corner segments, the separations being disposed between adjacent cube corner segments.

The adjacent cube corner segments can be conformably bonded together through a conformable carrier layer. The conformable carrier layer can comprise a continuous, transparent film which is bonded to front major surfaces of the cube corner elements through an optional, typically transparent, adhesive layer. For example, the conformable carrier layer can comprise a 2 mil (50 micron) thick, plasticized poly(vinyl chloride) film or polyurethane film (made from polyurethane pellets having the trade designation 58277 from B. F. Goodrich Company, Specialty Polymers & Chemical Division of Cleveland, Ohio or polyurethane pellets having the trade designation PN-3429 or PN-03 from Morton International, specialty Chemicals Group, of Seabrook, N.H.). Alternatively, the conformable carrier layer can comprise ionomers of polyethylene copolymers such as Surlyn™ 9910 from Du Pont Company, Polymer Products Department, of Wilmington, Del., poly(ethylene-methacrylic acid) copolymers; poly(ethylene-acrylic acid) copolymers; or fluorocarbon polymers. The cube corner segments may comprise, for example, poly(methyl methacrylate) resin. Both the conformable carrier layer and optional adhesive layer comprise a low modulus material relative to the material of the cube corner reflective elements.

Other suitable flexible cube-corner retroreflective sheetings are disclosed in U.S. patent application Ser. No. 08/472,444, which is a continuation-in-part of U.S. patent application Ser. No. 08/326,696, which is a continuation-in-part of U.S. patent application Ser. No. 08/285,648, which is a continuation-in-part of U.S. application Ser. No. 08/139,433 filed Oct. 20, 1993, all of which are incorporated herein by reference.

Briefly, these patent applications disclose composite retroreflective sheetings that comprise an array of substantially independent cube-corner elements and an overlay film or body portion having first and second major surfaces. The cube corner element array is bonded to the overlay film's first major surface. The array and the overlay comprise first and second light transmissible polymeric materials that have a difference in elastic modulus of at least 1 to $1.5\times10^7$ pascals. The array of cube-corner elements preferably has an elastic modulus greater than $16\times10^8$ pascals, more preferably greater than $18\times10^8$ pascals, and even more preferably greater than $25\times10^8$ pascals. The overlay film preferably comprises a low elastic modulus polymeric material; that is, one having an elastic modulus less than $13\times10^8$ pascals, more preferably less than $7\times10^8$ pascals, and even more preferably less than $3\times10^8$ pascals. The cube-corner array preferably is fractured around each cube-corner element to provide a fractured separation of each individual cube-corner element from surrounding cube-corner elements. The cube-corner sheeting may possess a land layer between the overlay film and the cube-corner elements. The land layer preferably has a thickness of less than about 10 percent of the average height of the cube-corner elements. The backside of the cube-corner elements is coated with a microthin coating of metal such as chromium, aluminum, silver, or combinations thereof to promote retroreflectivity.

The conformable cube corner retroreflective sheetings described above perform very well on snowplowable pavement markers of this invention. It has been discovered that these retroreflective sheetings, particularly when the backside of the cube corner elements are coated with metal, exhibit excellent durability under the rigorous conditions required for snowplowable pavement markings. The retroreflective sheetings are able to provide superior durability without sacrificing retroreflective performance.

FIGS. 4 and 5 show a retroreflective sheeting 12 preferably affixed as mentioned above, to a recessed portion of the marker body member 10 with a flexible, weatherable adhesive system 13, specifically 3M VHB (Very High Bond) tape available from Minnesota Mining and Manufacturing Company, St. Paul, Minn. Retroreflector colors may be specific and regulated relative to their position and function when used on a roadway.

FIG. 11 shows the construction of highly flexible retroreflector 12 and the highly flexible adhesive system 13 applied to the marker body 10. The drawing is proportionate In thickness with the retroreflector material being approximately 0.010 inches thick and the adhesive system approximately 0.020 inches thick. Due to the highly flexible adhesive 58,60 (a high shear acrylic type), the adhesive 58 integrates about the entire metallised cube corner facet section 57 of the assembly such that the thickness dimensions of the two components, retroreflector 12 and adhesive component 13, overlap.

The effective high surface area created by the microprismatic cube corner elements allows an exceptionally strong bond to be achieved between the cube corner sheeting and the adhesive.

The fact that the cube corner elements 57 are independent of each other, being hinged at their bases where they are bonded to flexible laminate layer 56, allows the total combination of retroreflector 12, adhesive laminate 13 and the marker body 10 to act in concert and remain bonded when flexed by impact of marker body 10. The interlayer 59, of the adhesive system, is a flexible, resilient, acrylic foam. The retroreflector top laminate 55 is a flexible, abrasion resistant film.

In this invention, there is little or no peripheral growth of the marker body about the upper region 19 of base portion 31 when subjected to plow impact, allowing the marker to be installed in pavement with a rigid grout or alternatively within an annular ring mounting device that has been placed in a cavity in the pavement. A flexible grout may be desirable in certain applications and may be used. The marker body is preferably vented to atmosphere to prevent entrapped air within the cavity from counteracting deformation of the top portion of the body member. As indicated above, the vent also assists in releasing moisture from the pavement marker's interior. Venting may be achieved by, for example, completing a partial hole 16 in the top-section of the marker body 10 or by vent channels in an annular ring mounting device (discussed below) if used to mount the marker body in the pavement. The combination of marker venting and ultimate flexibility of the pavement marker, results in a marker body member that presents little resistance to deformation by snowplow blades. Low resistance to impact from snowplow blades prevents cutting and catching actions on the marker body members.

Figure 6:
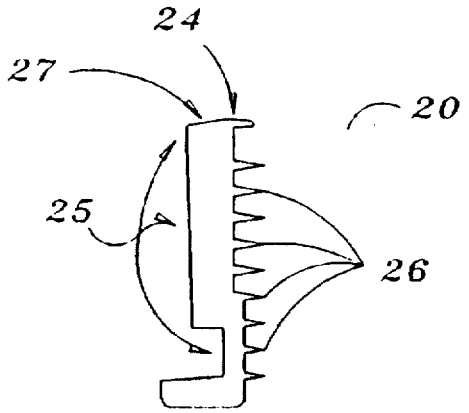
FIG. 6 is a cross sectional view of the annular ring of FIG. 2 taken along section line 21—21.

FIGS. 2 and 6 show a mounting device in the form of an annular ring 20 that may be used as an alternative to mounting the marker in pavement with a rigid or flexible grout. The mounting device comprises an annular wall of flexible synthetic material having an inner surface 25 and an outer surface (not referenced). The inner surface 25 is adapted to mechanically engage an object, in particular a marker body member (although the mounting device could be used to mount other useful objects in a pavement borehole). The outer surface of the mounting device 20 has a plurality of annular ribs 26 adapted to engage the pavement around a borehole. The ribs preferably have a diameter larger than the diameter of the borehole (preferably at least 3.3 percent larger) so that the ribs deflect upwardly when engaged with the pavement. The ribs upward deflection allows the marker to resist removal from the borehole as shown in FIG. 7.

The mounting device can perform multiple functions: mounting the marker within the pavement cavity at a proper height; providing easy, fast replacement of marker body members when refurbishing is required; and counteracting the asphalt creep process, which could compromise marker cavity integrity and lead to unsafe roadway conditions. Under hot weather conditions and heavy vehicular traffic, asphalt becomes pliable and has a tendency to "creep" and fill cavities in pavement. If the creep is left unchecked, the integrity of the marker's base portion may be compromised and depressions may form in the pavement about the periphery of the marker. In wet, cold weather, ice could form in these depressions presenting a hazard to traffic.

Figure 9:
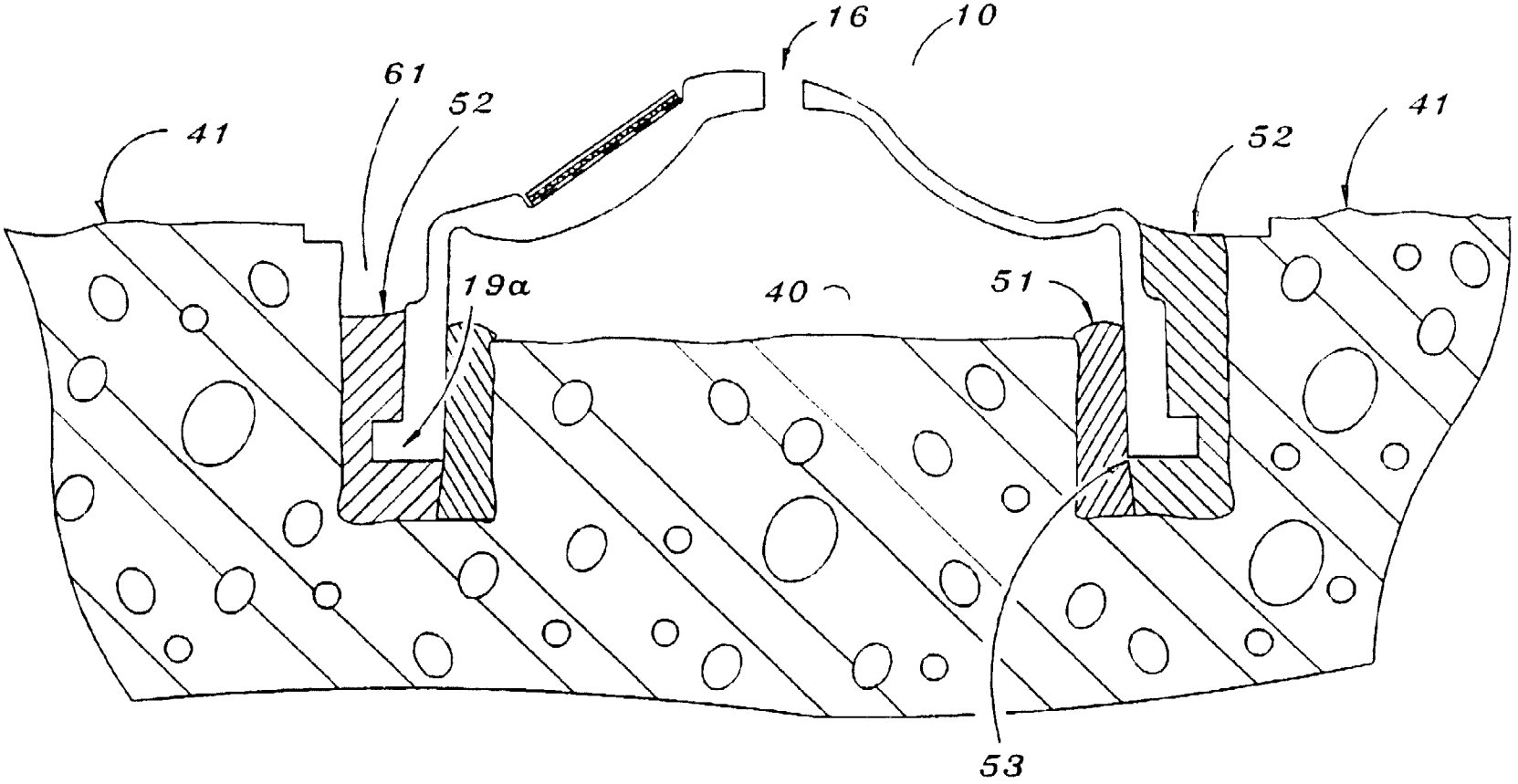
FIG. 9 is a cross-sectional view of an embodiment of the invention using a closed cell foam band as shown in FIG. 8.

As shown in FIGS. 1 and 2, the inner surface 25 of ring 20 is designed to receive flange 19*a* of the base portion 31. The outer surface of base portion 31 preferably fits snugly against the inner surface 25 of ring 20. The snug fit can reduce ingress of moisture and debris into the assembly that could compromise the pavement marker's performance. The snug fit could be limited to the lower regions of the marker body's base portion 31 and mounting device ring 20, as shown on the left side of FIG. 7 to provide an annular airspace or gap 28 between the base portion 31 of the marker body member and the inner surface 25 of the mounting device ring in the upper region of the base portion 31. This gap 28 provides additional flexibility to the marker top-section allowing a faster, more compliant response of the top portion 32 of the marker to plow impact to further improve the marker's ability to survive. As mentioned, the upper one third of the marker body base portion 31 may be thinned to one half the wall thickness of the lower portion to provide additional lateral flexibility to the marker body 10. This geometry acts in concert with the gap 28 in the mounting device 20. Air currents on roadway surfaces caused by high speed traffic flow can tend to keep such a gap clear of particulates. In the case of no annular ring mounting device in use as shown in FIG. 9, where the marker body is grouted in place, partial grouting 61 above the flange 19*a* can produce such a gap.

The mounting device ring may be pressed into a bored pavement cavity without grout. This allows for rapid installation because cavities, bored in the pavement with water-flushed drills, require drying before grouting. An efficient method of installing the marker 10 or another object and the mounting device ring 20 involves pressing the preassembled combination of the mounting device 20 and the marker 10 into the pavement borehole 40. This may be accomplished manually, using a hammer, or a hydraulic power ram. The drill that formed the borehole, may be used for this purpose as it contains such a hydraulic power ram.

Figure 12:
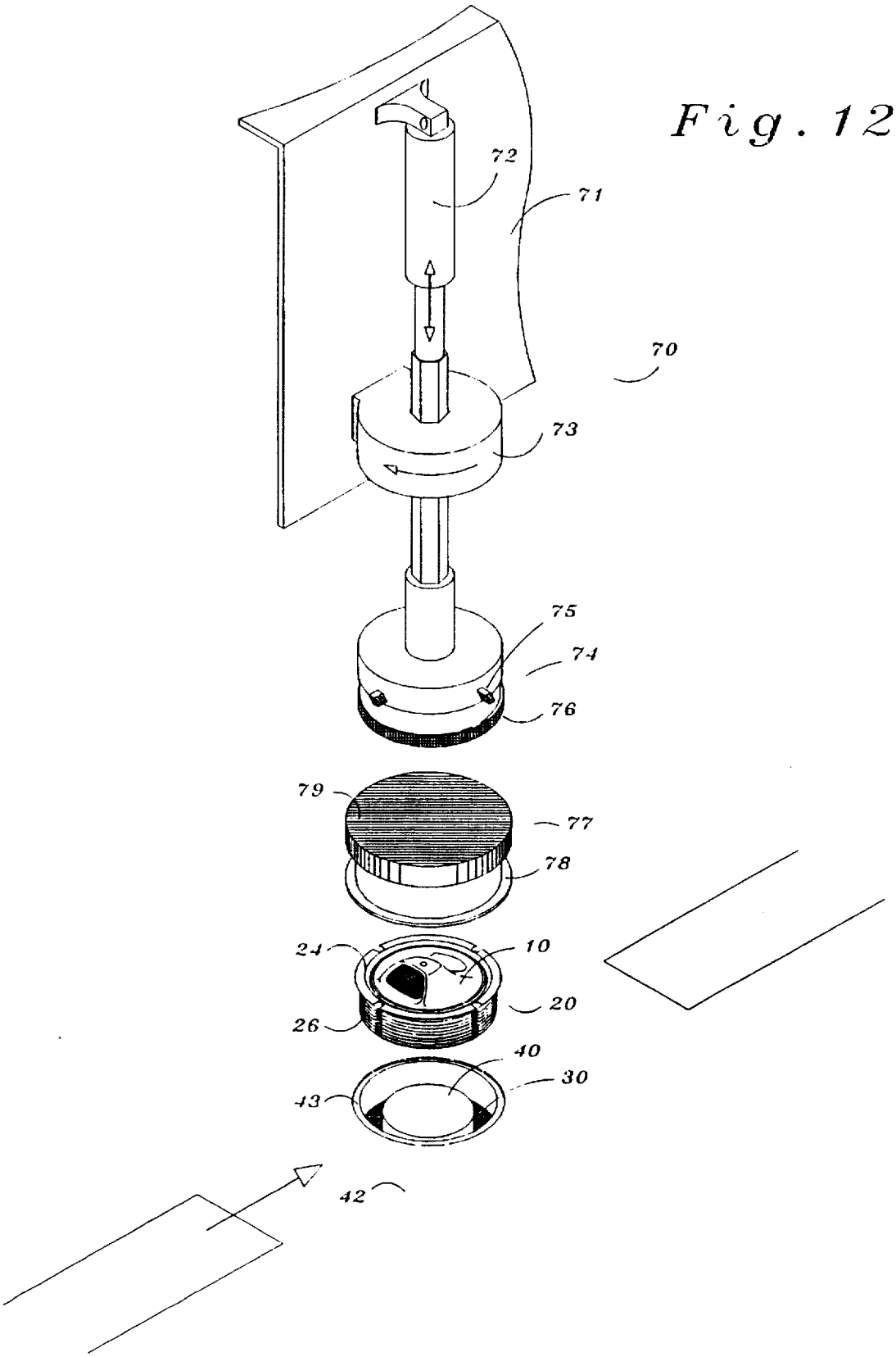
FIG. 12 is a perspective view showing borehole drilling equipment and components and illustrating a novel installation method for the pavement marker system.
Figure 13:
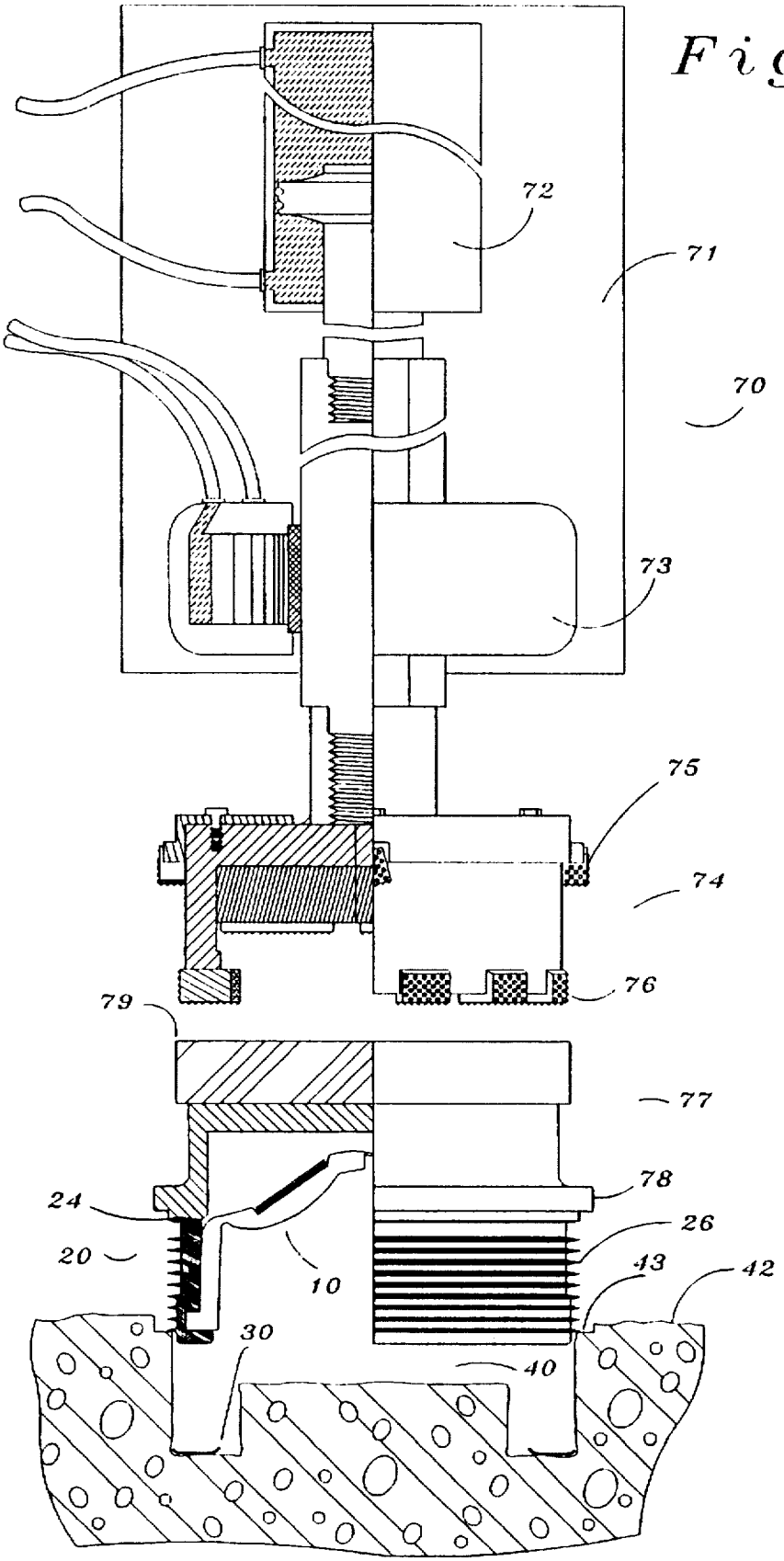
FIG. 13 is a side view, partly in cross-section, of the drilling equipment and components of FIG. 12.

FIGS. 12 and 13 show borehole drilling equipment 70, including unique drill bit 74 and insertion fixture 77 and illustrates a novel installation method for the pavement marker system. The hydraulically powered drilling equipment 70 is typically mounted on a vehicle 71 which also carries a hydraulic power unit which is rated, typically between twenty and eighty horsepower. The vehicle 71 (shown only in portion) may also carry hundreds of gallons of water for cooling the drill bit 74 and flushing debris from the pavement borehole 40. A hydraulic motor 73 rotates the drill bit 74 during borehole drilling while hydraulic ram 72 simultaneously drives the drill bit 74 downward into the pavement 42. Water is pumped into the interior of the drill bit during the drilling operation. Drill bit 74 contains unique "kerf" cutting components 75 (located on the upper periphery of the drill bit) to ensure pavement markers 10 are installed at proper operating depth in the pavement 42. The "kerf cutters" cut a kerf 43 which circumscribes the borehole at the pavement top surface when the lower cutting components 76 of the drill bit 74 have reached proper borehole depth. The drill bit 74 is then raised by hydraulic ram 72 and the borehole 40 is cleared of water and debris. A preassembly of marker 10 and mounting device 20 is then placed in the borehole 40 with the lower heel of the mounting device 20 being small enough to fit in the borehole 40 thus providing a centering function for the preassembly. An insertion fixture 77, having a lower flange 78, which conforms to and centers on the mounting device upper rim 24, is placed over the preassembled marker/mounting device. The insertion device does not touch the marker 10. The lower flange 78 of the insertion fixture 77 extends radially beyond the periphery of the mounting device 20 but is small enough in radial dimension to fit within the diameter of the kerf 43 of the borehole 40. The fixture 77 also has an upper surface 79 made from highly resilient material designed to be contacted by the drill bit lower cutting elements 76 without damaging the fixture 77 or the cutting elements 76. The drill bit 74, which remains centered above the borehole 40, is then driven downwards by hydraulic ram 72 thus contacting and driving the insertion fixture 77 and the marker/mounting device assembly into the borehole 40. The downward travel of all components is controlled and stopped when the lower radially extended flange 78 of the insertion fixture 77 contacts the kerf face 43 of the borehole 40. In this method, no excessive hydraulic pressure is applied to the devices mounted within the borehole as proper insertion depth of the marker/mounting device is controlled by the relative dimension of drill bit cutting elements 75,76 and the interaction of insertion fixture flange 78 and borehole kerf 43. During the insertion method, the ribs 26 of the mounting device 20 deform upwards and grip the inner surface of the borehole 40. The drill bit 74 is not rotated by the hydraulic motor 73 during the insertion method nor is water pumped to the drill bit 74. Proper insertion of the pavement marker 10 and mounting device 20 by this method is efficiently accomplished in a few seconds. Ring seal 30 may or may not be used in this method.

FIG. 7 shows a sectional view of the marker 10, mounted in an annular ring mounting device in a pavement cavity 40. The gripping ribs 26 are shown deformed and captured within a grout 50 injected between the outer surfaces of the mounting device ring 20 and the pavement 42. The upper rim 24 resides Just below the pavement surface 41 within the vertical cut dimension. The inner top-section 27 of ring 20 is at a reduced elevation to the uppermost rib to avoid capture by a snowplow blade and resides below the pavement surface 41.

FIG. 2 shows a plurality of axially extending channels 22, each spaced at approximately ninety degrees to an adjacent channel. The channels are disposed on the outer surface of the annular ring 20, to vent the interior cavity and may alternatively be used as channels for grout 50 to further anchor the ring into the pavement. It is contemplated that a single channel may provide satisfactory venting, but a plurality of channels is preferred to ensure good venting and to avoid the possibility of inadequate venting which could occur if a single channel were to be blocked, for example, by debris. Use of grout depends on size and quality of the bore cavities, paving materials and pavement conditions. The ring of the mounting device may be fabricated as a single component (i.e. integral) or it may be molded as a plurality of separate parts adapted to be locked together as shown in FIG. 2 with the ring fabricated in two pieces Sectioning the ring provides a benefit regarding potential projective threat if a marker and ring become dislodged on the roadway in that the ring half weighs in the order of 60 grams and the flexible urethane marker in the order of 160 grams. Such weights and materials are unlikely to present a significant threat to motorists. A preferred material for the ring is a high density polyethylene such as HD 10062 available from the Dow Chemical Company. The mounting device ring 20 preferably conforms to the pavement topography and by having a flexible body member and, preferably, also conforms to the installed altitude. A major advantage of this system is that pavement markers can be pried in and out of the ring with ease. Installation and removal of pavement markers may be accomplished with a simple tool. The markers remain in the rings under the abusive forces of vehicular traffic and plows as these forces act normal to the pry removal force.

Figure 3:
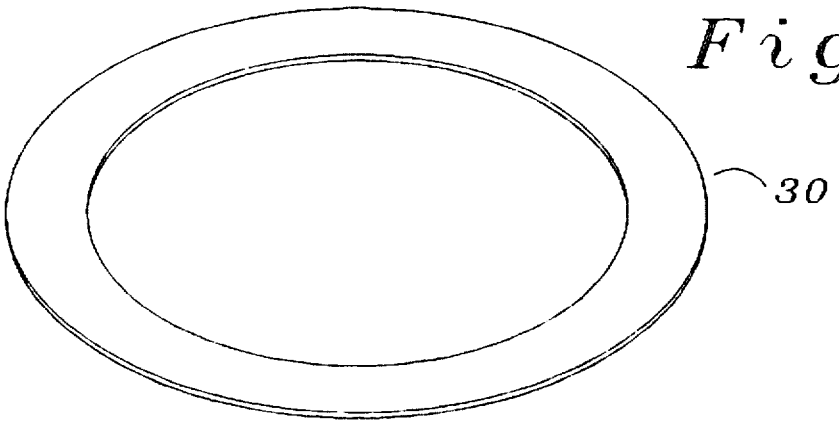
FIG. 3 is a perspective view of a flexible, closed-cell foam seal.

FIG. 3 shows a ring seal 30 that is dimensioned to fit the pavement cavity immediately below the annular ring 20. It may be manufactured from closed cell foam material such as cross-linked polyethylene foam (for example, T200 available from Voltek Inc., Lawrence, Mass.) and is intended to compress when the mounting device ring 20 is installed above it as shown in FIG. 7. The ring seal 30 preferably is resilient so that a fluid seal can be maintained between the pavement marker's interior and the ambient environment. The fluid seal prevents moisture from entering the pavement marker's interior. The ring seal 30 occupies space in the pavement cavity below the ring 20 preventing moisture from collecting in the pavement cavity. Moisture, when frozen, can expand to drive ring 20 upwards exposing it to the plowblade. Even if ring seal 30 does not fully occupy a gap below mounting device ring 20, due to excessive pavement bore cavity depth, it still effectively protects the mounting device ring 20 from being forced upwards in the bore cavity by freezing moisture. The expansion of moisture when freezing in the bore cavity would tend to compress the ring seal 30 before it would act upon the high friction mounted mounting device ring 20.

Differing combinations of the system components may be used for system installation under various conditions. Concrete presents a relatively smooth bored cavity that may reduce the friction lock of the polyethylene ring. As shown in FIG. 7, grout 50 may then be used to lock the ring 20 in the pavement cavity 40. Concrete generally has a low porosity, and therefore moisture within the cavity may be slow to drain. Ring seal 30 can be used under such circumstances to keep moisture from residing below the ring. The seal 30 would render vent channels 22 (FIG. 2) inoperative for venting and so too would grout 50. In this situation marker venting 16 can be accomplished by providing a hole 16 in the upper portion of the marker body 10. (For ease of molding the body member of the marker, only a partial hole is formed. It can easily be completed by punching or drilling.) Grout 50 also may be used in asphalt pavement when the cavity is oversized due to drill equipment eccentricity. The grout adheres to the pavement material and can form a mechanical lock in the plurality of ribs 26 of the annular ring 20. In applications where vehicular traffic is low in volume, for example a parking area, marker bodies 10 could be installed in bored cavities directly with rigid grout 50, or with softer more flexible grouts. The grouts may be used without annular ring 20 because these installations are unlikely to promote marker deterioration, and ease of replacement is less a concern. Ring seals 30 are not necessary for applications that do not involve annular ring mounting devices 20 because the grouts are used to set marker height and perform the function of the seal 30 and also perform the marker capture function, otherwise performed by the annular ring mounting device. Again, venting may be accomplished by providing a hole 16 in the marker body 10.

Figure 8:
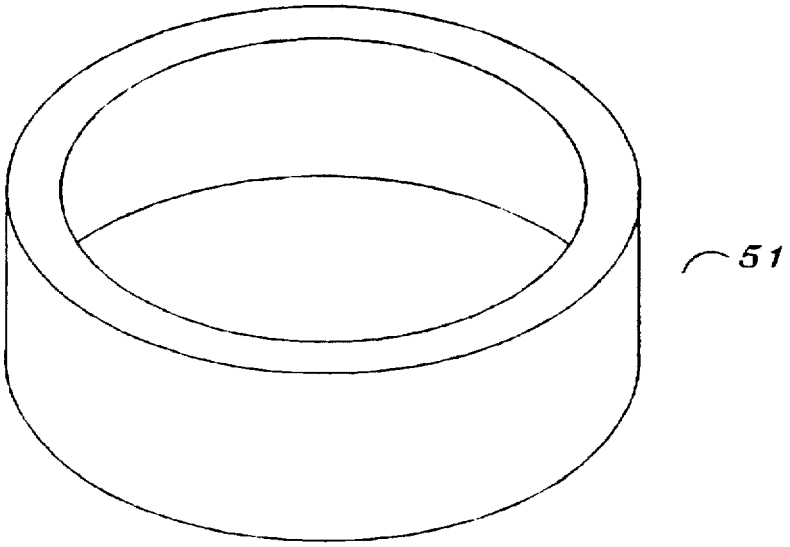
FIG. 8 is a perspective view of a closed cell foam band for use in another embodiment of the invention.

Referring to FIGS. 8 and 9, another embodiment of the invention is shown which uses closed cell, foam band 51. This band may be employed when the marker body member 10 is intended to be anchored in the pavement with grout 52. The band 51 is stretched and inserted about the central raised core section in the borehole 40. The body member 10 is then positioned onto and about the foam band 51, with the band 51 resiliently compressing and supporting the body member 10. The body member 10 may be manually adjusted to proper installation height relative to the pavement surface 41 by the use of the foam band in this embodiment. Grout 52 is then inserted into the borehole about the periphery of the marker body member 10. The foam band 51 prevents grout from entering the interior of the borehole cavity 40 and, more importantly, prevents grout from entering or residing behind the "heel" 53 of the marker lower base portion opposite the flange. The grout 52 remains in the pavement cavity and may not need to be replaced in the refurbishing operation. In essence, this method of installation of the marker body creates the beneficial equivalent of a mounting device within the borehole after the grout has cured. Partial grouting 61 as shown in FIG. 9 may also be employed to create the beneficial equivalent of the mounting device gap 28 shown in FIG. 7. As both grout 52 and foam band 51 effectively seal the interior of the body member 10 from the ambient environment, the hole 16 is provided to vent the marker body member 10 to atmosphere as shown in FIG. 9. Like the foam seal 30 shown in FIG. 3, the foam band 51 shown in FIG. 8 may be fabricated from closed cell polyethylene foam.

The action of the marker body in response to impact by a snowplow blade is schematically illustrated in FIG. 10, parts (a), (b) and (c). FIG. 10 uses the same reference numbers as FIG. 5 with the addition of reference number 54, which denotes a snowplow blade, and reference letter "A" which shows the low tangent angle of impact A maintained across the first stiff region 33 of the marker body from initial-impact, FIG. 10, part (a), to later stages shown in FIG. 10, parts (b) and (c). FIG. 10 also shows the flexible second section 14 deforming into the lower portion of marker 10 as the plow strike progresses, aided by the relatively fixed but highly flexible hinged area 18 around the periphery of the top portion of the marker 10 and also aided by the flexible upper base region **19*b*** which provides lateral movement of the top portion of the marker body.

Another hinge point is shown as hinged area 34 located between the first stiff region 33 and the flexible second region 14.

An advantage of the present invention is that it is essentially a totally non-metallic system. When pavement is resurfaced, cast metal units are extricated from pavement with tools such as Jack-hammers. The system of this invention may be consumed by a "scarifier" machine employed in resurfacing, making removal of the markers unnecessary. All components would melt and/or integrate into the used asphalt that may be recycled for subsequent use.

While the invention has been described with reference to preferred embodiments, it will be understood by those skilled in the art that various changes may be made and equivalents may be substituted for elements thereof without departing from the scope of the invention defined by the following claims.

The embodiments of the invention which an exclusive property or privilege is claimed are defined as follows:

1. A raised pavement marker for installation in a pavement borehole, the marker comprising a body member having a base portion and a generally dome-shaped top portion capable of being deflected downwardly into the base portion, wherein the top portion has a first stiffened region and a second flexible region, the first stiffened region has a surface for receiving a retroreflective material and the first and second regions are contigured relative to one another on the top portion such that when the marker is installed in a pavement borehole the first stiffened region is located in the direction of impact while the second flexible region is located opposite the first stiffened region in the top portion away from the direction of impact, and when the top portion receives an impact on the first region the second region deflects downwardly into the base portion and thereby assists in allowing the top portion to be deflected downwardly into the base portion, the pavement marker being sufficiently resilient to enable the top portion to return to its generally dome-shaped configuration upon release of the impact, wherein said top portion is joined to said base portion by a surrounding border region more flexible than said first and second regions, the border region allowing for lateral movement of the top portion upon such impact.

2. A marker as claimed in claim 1 wherein said base portion is tubular including a lower section having a first thickness and an upper section having a second thickness less than said first thickness.

3. A marker as claimed in claim 2 wherein said second thickness is approximately one-half said first thickness.

4. A raised pavement marker for installation in a pavement borehole, the marker comprising a body member having a base portion and a generally dome-shaped top portion, wherein the top portion has a first stiffened region and a second flexible region, said top portion is joined to said base portion by a surrounding border region more flexible than said first and second regions, said base portion is tubular including a lower section having a first thickness and an upper section having a second thickness approximately one-half said first thickness, said lower section has a height approximately twice the height of the upper section, said first stiffened region has a surface for receiving a retroreflective material and said first and second regions are contigured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives a force on the first region, the pavement marker being sufficiently resilient to enable the top portion to return to its generally dome-shaped configuration upon release of the force.

5. A marker as claimed in claim 4 wherein said second region is substantially larger than said first region.

6. A marker as claimed in claim 5 wherein said first region extends from said border region inwardly to beyond the center of the top portion.

7. A marker as claimed in claim 6 wherein said first region comprises approximately ⅓ of the top portion.

8. A marker as claimed in claim 6 wherein said second region has a downwardly concave portion disposed near said first region.

9. A marker as claimed in claim 6 wherein said concave portion is substantially symmetrical with respect to an imaginary plane bisecting said first and second regions.

10. A marker as claimed in claim 9 wherein said first region has a recessed portion adapted to receive a retroreflective element, said recessed portion being surrounded by a thickened section.

11. A marker as claimed in claim 10 wherein said retroreflective element is secured to said recessed portion by a flexible weatherable adhesive.

12. A marker as claimed in claim 11 wherein said body member is formed of polyurethane having a glass transition temperature (Tg) of −40° F. or lower.

13. A marker as claimed in claim 12 which is colored black.

14. A marker as claimed in claim 10 wherein said first region has a first average thickness, said second region has a second average thickness and said border region has a third average thickness, and wherein said second average thickness is less than said first average thickness and said third average thickness is less than said second average thickness.

15. A marker as claimed in claim 14 wherein said first average thickness, not including said recessed portion and said thickened section, is approximately 3 to 9 mm, preferably 5 to 8 mm, said second average thickness is approximately 1 to 5 mm, preferably 2 to 4 mm, and said third average thickness is approximately 20% less than said second average thickness.

16. A marker as claimed in claim 15 wherein said recessed portion has an average thickness of approximately 4 to 12 mm, preferably 6 to 10 mm, and said thickened section has a thickness of approximately 5 to 11 mm, preferably 8 to 12 mm.

17. A raised pavement marker for installation in a pavement borehole, the marker comprising a body member having a base portion and a generally dome-shaped top portion, wherein the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives an impact on the first region, the pavement marker being sufficiently resilient to enable the top portion to return to its generally dome-shaped configuration upon release of the impact and including an air vent that enables said top portion to deflect more rapidly into said base portion during such impact, wherein said vent comprises a hole in said top portion.

18. A marker as claimed in claim 17 wherein said base portion has an end opposite said top portion, said end having an outwardly extending circumferential flange.

19. A raised pavement marker for installation in a pavement borehole, the marker comprising a body member having a base portion and a generally dome-shaped top portion, wherein the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives an impact on the first region, the pavement marker being sufficiently resilient to enable the top portion to return to its generally dome-shaped configuration upon release of the impact and including an air vent that enables said top portion to deflect more rapidly into said base portion during such impact, wherein said vent includes a plurality of axially-disposed channels spaced around said base portion.

20. A raised pavement marker for installation in a pavement borehole, the marker comprising a body member having a base portion and a generally dome-shaped top portion, wherein the marker is colored black, the body member is formed of polyurethane having a glass transition temperature (Tg) of −40 °F. or lower, the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives a force on the first region, the pavement marker being sufficiently resilient to enable the top portion to return to its generally dome-shaped configuration upon release of the force and including a vent to the atmosphere comprising a hole in said top portion.

21. A raised pavement marker for installation in a pavement borehole, the marker comprising a body member having a base portion and a generally dome-shaped top portion, wherein said body member is formed of polyurethane having a glass transition temperature (Tg) of −40° F. or lower, the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives a force on the first region, the pavement marker being sufficiently resilient to enable the top portion to return to its generally dome-shaped configuration upon release of the force and including an air vent comprising a plurality of axially disposed channels spaced around said base portion.

22. A raised pavement marker for installation in a pavement borehole, the marker comprising a body member having a base portion and a generally dome-shaped top portion capable of being deflected downwardly into the base portion, wherein the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact, and when the top portion receives an impact on the first region the second region deflects downwardly into the base portion and thereby assists in allowing the top portion to be deflected downwardly into the base portion, the pavement marker being sufficiently resilient to enable the top portion to return to its generally dome-shaped configuration upon release of the impact, wherein said base portion is cylindrical and removably engages an inner surface of an annular wall of a device for mounting it in said borehole, said device being formed of flexible resilient synthetic material, said wall having an outer surface provided with a plurality of ribs adapted to engage said pavement within said borehole.

23. A marker as claimed in claim 22 wherein said ribs have a diameter slightly larger than the diameter of the borehole whereby, when said device is forcibly inserted in the borehole, said ribs deflect upwardly in engagement with the pavement around said borehole to resist removal from the borehole.

24. A marker as claimed in claim 23 wherein said second region of said body member is substantially larger than said first region.

25. A marker as claimed in claim 22 wherein said top portion is Joined to said base region by a surrounding border region more flexible than said first and second regions, and wherein said base portion is tubular including a lower section having a first thickness and an upper section having a second thickness less than said first thickness.

26. A marker as claimed in claim 25 wherein said second thickness is approximately one-half said first thickness.

27. A marker as claimed in claim 26 said resilient material is polyurethane.

28. A marker as claimed in claim 27 wherein said flexible synthetic material is high density polyethylene.

29. A raised pavement marker for installation in a pavement borehole, the marker comprising a body member having a base portion and a generally dome-shaped top portion, wherein the top portion has a first stiffened region and a second flexible region substantially larger than said first region, the first region extends from said border region inwardly to beyond the center of the top portion and has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives a force on the first region, the pavement marker being sufficiently resilient to enable the top portion to return to its generally dome-shaped configuration upon release of the force, and wherein said base portion is cylindrical and engages an inner surface of an annular wall of a device for mounting said device in said borehole, said device is formed of flexible resilient synthetic material, said wall has an outer surface provided with a plurality of ribs adapted to engage said pavement within said borehole, said ribs have a diameter slightly larger than the diameter of the borehole whereby, when said device is forcibly inserted in the borehole, said ribs deflect upwardly in engagement with the pavement around said borehole to resist removal from the borehole.

30. A marker as claimed in claim 29 wherein said first region comprises approximately ⅓ of the top portion.

31. A marker as claimed in claim 30 wherein said concave portion is substantially symmetrical with respect to an imaginary plane bisecting said first and second regions.

32. A marker as claimed in claim 29 wherein said second region has a downwardly concave portion disposed near said first region.

33. A marker as claimed in claim 32 wherein said first region has a recessed portion adapted to receive a retroreflective element.

34. A marker as claimed in claim 33 wherein said resilient material is polyurethane having a glass transition temperature (Tg) of −40° F. or lower.

35. A marker as claimed in claim 32 wherein said retroreflective element is secured to said recessed portion by a flexible, weatherable adhesive.

36. A raised pavement marker for installation in a pavement borehole, the marker comprising a body member having a base portion and a generally dome-shaped top portion, wherein the top portion has a first stiffened region and a second flexible region, said top portion is joined to said base portion by a surrounding border region more flexible than said first and second regions, said base portion is tubular including a lower section having a first thickness and an upper section having a second thickness approximately one-half said first thickness, said lower section has a height approximately twice the height of the upper section, said first stiffened region has a surface for receiving a retroreflective material and said first and second regions are configured relative to one another on the top portion such that when the marker is installed in a pavement borehole the first stiffened region is located in the direction of impact while the second flexible region is located opposite the first stiffened region in the top portion away from the direction of impact and assists in allowing the top portion to be deflected downwardly into the base portion when the top portion receives a force on the first region, the pavement marker being sufficiently resilient to enable the top portion to return to its generally dome-shaped configuration upon release of the force, and wherein said base portion is cylindrical and engages an inner surface of an annular wall of a device for mounting said device in said borehole, said device is formed of flexible resilient synthetic material, said wall has an outer surface provided with a plurality of ribs adapted to engage said pavement within said borehole.

37. A marker as claimed in claim 36 including an air vent.

38. A marker as claimed in claim 37 wherein said vent comprises a hole in said top portion.

39. A marker as claimed in claim 37 wherein said vent comprises a plurality of axially extending channels dividing said ribs.

40. A marker as claimed in claim 39 wherein said tubular base portion has an end opposite said top portion, said end having an outwardly extending circumferential flange.

41. A marker as claimed in claim 40 and further comprising a ring of closed cell foam material disposed beneath said inwardly directed bottom flange.

42. A marker as claimed in claim 41 wherein said foam material is flexible grade polyethylene.

43. A raised pavement marker that comprises a body member having a base portion and a generally dome-shaped top portion, said top portion having a hole venting said marker to atmosphere and enabling said top portion rapidly to be deflected downward into the base portion upon receiving a force on the top portion, the pavement marker being sufficiently resilient to enable the top portion to return to its generally dome-shaped configuration upon release of the force.

44. A raised pavement marker as claimed in claim 43 wherein said top portion has a first region and a second region, said second region being more flexible than said first region.

45. A marker as claimed in claim 43 wherein said top portion is joined to said base portion by a surrounding border that acts as a hinge, allowing the top portion to be deflected downwardly into the base portion.

46. A raised pavement marker that comprises a body member having a base portion and a generally dome-shaped top portion, said top portion having a hole venting said marker to atmosphere and being capable of being deflected downward into the base portion upon receiving a force on the top portion, the pavement marker being sufficiently resilient to enable the top portion to return to its generally dome-shaped configuration upon release of the force, wherein said top portion is joined to said base portion by a surrounding border that acts as a hinge, allowing the top portion to be deflected downwardly into the base portion, and said base portion is tubular including a lower section having a first thickness and an upper section having a second thickness less than said first thickness.

47. A marker as claimed in claim 46 wherein said second thickness is approximately one-half said first thickness.

48. A marker as claimed in claim 47 wherein said lower section has a height approximately twice the height of the upper section.

49. A raised pavement marker for installation in a pavement borehole, in combination with a band of closed cell foam material, the marker comprising a body member having a base portion and a generally dome-shaped top portion capable of being deflected downwardly into the base portion, wherein the top portion has a first stiffened region and a second flexible region, the first stiffened region has a surface for receiving a retroreflective material and the first and second regions are configured relative to one another on the top portion such that when the marker is installed in a pavement borehole the first stiffened region is located in the direction of impact while the second flexible region is located opposite the first stiffened region in the top portion away from the direction of impact, and when the top portion receives an impact on the first region the second region deflects downwardly into the base portion and thereby assists in allowing the top portion to be deflected downwardly into the base portion, the pavement marker being sufficiently resilient to enable the top portion to return to its generally dome-shaped configuration upon release of the impact, said band being adapted to be stretched and inserted about a central core of a borehole in pavement, said band having an unstretched diameter less than the diameter of said central core, said base portion of said marker being adapted to be positioned onto and about said band with the band compressing and supporting said marker so that said top portion of the marker extends above the surface of the pavement, said marker being capable of being anchored in thepavement with grout.

* * * * *